United States Patent [19]

Weinberg et al.

[11] Patent Number: 4,497,705

[45] Date of Patent: Feb. 5, 1985

[54] FLUID COKING WITH SOLVENT SEPARATION OF RECYCLE OIL

[75] Inventors: Harold N. Weinberg, Livingston; Charles Rebick, Annandale; Kenneth O. McElrath, Iselin, all of N.J.

[73] Assignee: Exxon Research & Engineering Co., Florham Park, N.J.

[21] Appl. No.: 523,960

[22] Filed: Aug. 17, 1983

[51] Int. Cl.[3] ..... C10G 9/32

[52] U.S. Cl. ..... 208/127; 208/309

[58] Field of Search ..... 208/127, 86, 309

[56] References Cited

U.S. PATENT DOCUMENTS

| | | | |
|---|---|---|---|
| 2,700,637 | 1/1955 | Knox, Jr. | 208/309 |
| 2,727,853 | 12/1955 | Hennig | 208/86 X |
| 2,777,802 | 1/1957 | Peet . | |
| 2,890,999 | 6/1959 | Polack | 208/127 |
| 2,901,413 | 8/1959 | Newchurch et al. | 208/86 X |
| 2,926,129 | 2/1960 | Kimberlin, Jr. et al. | 208/127 |
| 2,943,995 | 7/1960 | Mertes . | |
| 3,172,840 | 3/1965 | Paterson . | |
| 3,247,095 | 4/1966 | Conwell . | |
| 3,661,543 | 5/1972 | Saxton | 208/127 X |
| 3,707,462 | 12/1972 | Moss | 208/127 |
| 4,057,487 | 11/1977 | Metrailer et al. . | |
| 4,213,848 | 7/1980 | Saxton | 208/127 |

*Primary Examiner*—Delbert E. Gantz
*Assistant Examiner*—Glenn A. Caldarola
*Attorney, Agent, or Firm*—Marthe L. Gibbons

[57] ABSTRACT

A fluid coking process is provided in which a stream of heavy oil product, which typically is recycled to the coking zone, is first subjected to solvent separation to separate it into a high Conradson carbon product and a lower Conradson carbon product and, thereafter, at least a portion of the lower Conradson carbon product is recovered and the high Conradson carbon product is recycled to the coking zone.

8 Claims, 1 Drawing Figure

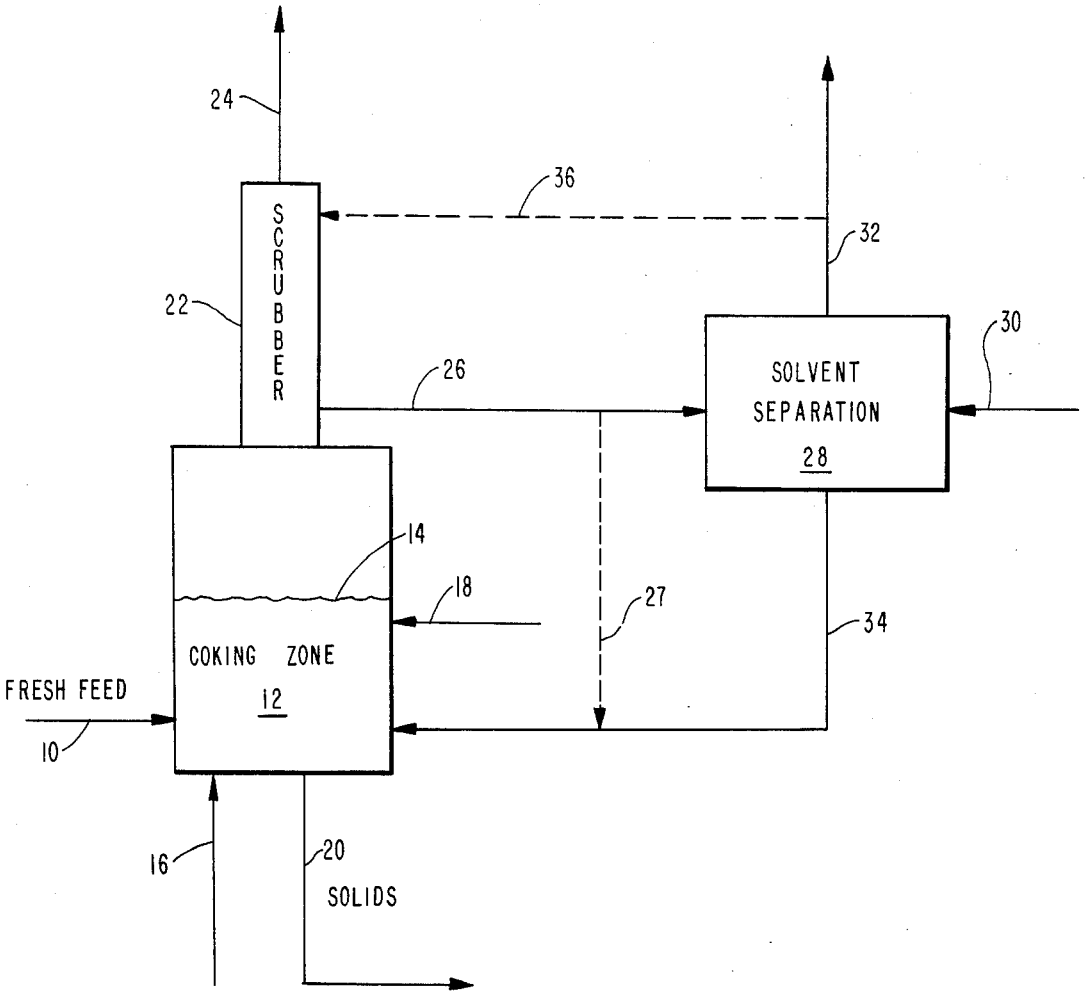
24
36
32
SCRUBBER
22
30
26
SOLVENT
SEPARATION
28
14
18
27
34
COKING ZONE
12
FRESH FEED
10
16
20
SOLIDS

FLUID COKING WITH SOLVENT SEPARATION OF RECYCLE OIL

BACKGROUND OF THE INVENTION

1. Field of the Invention

The present invention relates to an improvement in a fluid coking process.

2. Description of the Prior Art

Fluid coking is a well known process. See, for example, U.S. Pat. No. 2,881,130, the teachings of which are hereby incorporated by reference. The fluid coking process can be conducted with or without recycle of the heavy constituents of the coking product. Integrated fluid coking and coke gasification processes are also known and disclosed, for example, in U.S. Pat. Nos. 3,702,516; 3,759,676; and 4,325,815, the teachings of which are hereby incorporated by reference.

The present invention is applicable to conventional fluid coking processes as well as to integrated fluid coking and gasification processes.

U.S. Pat. No. 4,057,487 discloses a fluid coking process in which the heavy oil stream separated from the coker products in a scrubbing zone is passed to a vacuum distillation zone and a vacuum distillation zone bottoms fraction is recycled to the coking zone. Although such a scheme decreases the amount of lighter materials of the scrubber bottoms that needs to be recycled to the coking zone, there still remains a significant amount of relatively low Conradson carbon content constituents in the recycle stream. It would be desirable to find a method that would permit more of the low Conradson carbon constituents of the scrubber bottoms to be removed from the recycle oil stream since there would be no need to crack additionally these materials in the coker and since their presence in the recycle oil only adds to the size of the coking reactor and to the heat requirements of the process.

U.S. Pat. No. 2,777,802 discloses, in FIG. 2, a fluid coking process in which the total coke overhead product is subjected to extractive distillation to remove metal contaminants. A bottoms product from the extractive distillation zone may be recycled to the coking zone.

U.S. Pat. No. 2,943,995 discloses a two-stage coking process in which a gas oil fraction separated from the first coking stage product is extracted with a solvent selective for aromatics, and the extracted aromatics are coked in the second coking stage.

U.S. Pat. No. 3,247,095 discloses coking a reduced crude and recycling fractionator bottoms to the coker. As shown in FIGS. I and II, a coker gas oil is withdrawn and solvent extracted. The extract is stripped and the stripped extract is recovered.

U.S. Pat. No. 3,172,840 discloses a delayed coking process in which the effluent in FIG. I is fractionated. A gas oil sidestream from the tower is thermally cracked and recycled to the coke drums.

It has now been found that solvent separation of the coker recycle oil and recycle of only the higher Conradson carbon hydrocarbonaceous stream to the coking zone will produce advantages that will become apparent in the ensuing description.

SUMMARY OF THE INVENTION

In accordance with the invention there is provided, in a fluid coking process comprising the steps of: (a) contacting a carbonaceous chargestock with hot fluidized solids in a fluidized bed contained in a coking zone at coking conditions to produce coke which deposits on said fluidized solids, and a vapor phase product, including heavy and light normally liquid hydrocarbons, and (b) separating at least a portion of said heavy hydrocarbons from said vapor phase product, the improvement which comprises: (c) subsequently contacting at least a portion of said separated heavy hydrocarbons with a solvent in a solvent separation zone at separation conditions to separate said heavy hydrocarbons into a high Conradson carbon hydrocarbonaceous product and a low Conradson carbon hydrocarbonaceous product, and (d) recycling at least a portion of said high Conradson carbon hydrocarbonaceous product to said coking zone.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous material is passed by line 10 into coking zone 12 in which is maintained a fluidized bed of solids (e.g., coke particles of 40 to 1000 microns in size) having an upper level indicated at 14. Carbonaceous feeds suitable for the coking zone of the present invention include heavy hydrocarbonaceous oils; heavy and reduced petroleum crude; petroleum atmospheric distillation bottoms; petroleum vacuum distillation bottoms; pitch, asphalt, bitumen, other heavy hydrocarbon residues; tar sand oil; shale oil; coal; coal slurries; liquid products derived from coal liquefaction processes, including coal liquefaction bottoms, and mixtures thereof. Typically such feeds have a Conradson carbon content of at least about 5 weight percent, generally from about 5 to about 50 weight percent, preferably above 7 weight percent (as to Conradson carbon residue, see ASTM test D 189-65). A fluidizing gas, e.g., steam, is admitted at the base of coker 1 through line 16 in an amount sufficient to obtain superficial fluidizing gas velocities in the range of 0.5 to 5 feet per second. The fluidizing gas may comprise steam, vaporized normally liquid hydrocarbons, normally gaseous hydrocarbons, hydrogen, hydrogen sulfide, and mixtures thereof. Typically, the fluidizing gas will comprise steam. Solids at a temperature above the coking temperature, for example from 100 to 800 Farenheit degrees above the actual operating temperature of the coking zone, are admitted to coker 1 by line 18 in an amount sufficient to maintain the coking temperature in the range of about 850° to about 1,800° F. For the production of fuels, the coking temperature will range preferably from about 850° to about 1200° F., more preferably from about 900° to about 1200° F., whereas for the production of chemicals, the temperature will preferably range from about 1200 to about 1800. The pressure in the coking zone is maintained in the range of about 0 to about 150 pounds per square inch gage (psig), preferably in the range of about 5 to about 45 psig. The lower portion of the coker serves as stripping zone to remove occluded hydrocarbons from the solids. A stream of solids is withdrawn from coker 1 by line 20 for passage to a coke burner, a coke heater or a coke gasifier wherein the coke is heated and recirculated to the coker. In coking zone 12, the carbonaceous feed introduced into the coker is cracked by contact with the hot fluidized solids to coke, which deposits on the solids, and to a vaporous product, including heavy and light normally liquid hydrocarbons.

The vaporous coker product, which includes gaseous and normally liquid hydrocarbon products, is removed overhead from scrubbing zone 22 by line 24 for a subsequent fractionation and gas recovery. The scrubbing zone is a separation zone in which the heavier constituents of the vapor phase coker product are separated by condensation from the lighter constituents. The bottoms fraction of the scrubbing zone, which comprises the condensed heavy portion of the vaporous coker product, is withdrawn from scrubbing zone 22 by line 26 and at least a portion, preferably all is passed to solvent separation zone 28. If desired, a portion of the bottoms fraction may be recycled to the coking zone by line 27. The initial atmospheric pressure boiling point of the bottoms fraction of the scrubber will generally range from about 650° F. to about 975° F.

The Conradson carbon content of the bottoms fraction of the scrubber which is passed to the solvent separation zone, will generally range from about 5 to about 50 weight percent. A solvent is introduced into solvent separation zone 28 by line 30 to contact the bottoms fraction of the scrubber. The solvent may be any suitable solvent known to be useful for separating lower Conradson carbon materials from higher Conradson carbon materials. The solvents may be those used either for deasphalting or for extraction or a combination thereof. Suitable extraction solvents include $C_1$ to $C_5$ alcohols, ketones such as acetone; ethanolamine; N-methyl pyrrolidone; gamma butyrolactone and mixtures thereof. Solvent extraction methods are well known in the art and are described, for example, in the Kirk-Othmer Encyclopedia of Chemical Technology, Vol. 9, John Wiley & Sons, 1980, pages 672 to 721.

Suitable deasphalting solvents include $C_3$ to $C_{16}$ aliphatic hydrocarbons, preferably $C_3$ to $C_{10}$ aliphatic hydrocarbons, more preferably $C_4$ to $C_{10}$ aliphatic hydrocarbons and mixtures thereof. Deasphalting methods utilizing solvents that precipitate asphaltenes are well known and are described, for example, in Kalichevsky, *Petroleum Refining with Chemicals*, Elsevier Publishing Co., 1956, pages 388–396. Suitable volumetric ratios of solvent to bottoms fraction will generally range from about 0.5:1 to 10:1, preferably 1:1 to 4:1.

The solvent contacting step is conducted at conditions and for a time sufficient to separate the bottoms fraction of the scrubber into a high Conradson carbon content hydrocarbonaceous product stream and a lower Conradson carbon hydrocarbonaceous stream. The Conradson carbon content of the low Conradson carbon stream will be less than that of the bottoms fraction of the scrubber which is passed to the solvent separation zone. The Conradson carbon content of the high Conradson carbon stream will be greater than the Conradson carbon content of the bottoms fraction of the scrubber that is passed to the solvent separation zone. Suitable conditions for deasphalting with pentane include, for example, a temperature ranging from about 170° to about 400° F., a pressure ranging from 50 to 500 psig and a time period ranging from 5 minutes to 2 hours.

Since the low Conradson carbon constituents can be recovered from the bottoms fraction of the scrubber by the solvent separation method, the cut point of the bottoms fraction of the scrubber may be lower in the process of the present invention than the cut point of the scrubber bottoms fraction which is recycled without intervening separation.

The low Conradson carbon content stream is removed from solvent separation zone 28 by line 32. If desired, the solvent may be separated from the stream. This stream may be sent to a catalytic cracking process or other conversion or recovery processes. If desired, a portion of this stream may be recycled to the scrubber by line 36 to improve operability. The high Conradson carbon stream is withdrawn from solvent separation zone 28 and recycled by line 34 to coking zone 12. The amount of recycle is not critical and will vary widely.

Separation of the scrubber bottoms by means of a solvent contacting step such as solvent extraction or solvent deasphalting permits improved recovery of the low Conradson carbon materials and thereby decreases the amount of remaining materials to be recycled to the coker. Since the portion of bottoms to be recycled is reduced, the process heat requirements will also be reduced. Furthermore, the process scheme of the present invention would also permit use of a smaller size coker. It would also be possible to operate the coker at a lower severity without increasing the recycle stream.

SEPARATION EXPERIMENTS

The following separation experiments are provided to illustrate the solvent separation step of the present invention.

EXPERIMENT 1

A hydrocarbonaceous heavy bottoms fraction of a scrubber in which a coker product was condensed was treated with the solvent isopropanol. The scrubber bottoms fraction had a Conradson carbon content of 23 wt.%. The solvent treat ratio was 3 weights of solvent to 1 weight of oil. Three successive treats with fresh solvent were employed for a total of 9 weights of solvent per weight of oil. The oil in the solvent phases (low Conradson carbon product) and the oil in the final asphaltic phase (high Conradson carbon product) were analyzed for Conradson carbon and the results are given in Table I.

TABLE I

| | | | Low Conradson Carbon Product (Solvent Phase) | | High Conradson Carbon Product (Asphaltic Phase) | |
|---|---|---|---|---|---|---|
| Treat # | Temp. (°C.) | Pressure (Atmospheres) | Yield (Wt. %) | Conradson Carbon (Wt. %) | Yield (Wt. %) | Conradson Carbon (Wt. %) |
| 1 | 80 | 1 | 33 | 11 | — | — |
| 2 | 80 | 1 | 19 | 14 | — | — |
| 3 | 80 | 1 | 10 | 18 | 38 | 37 |

EXPERIMENT 2

The procedure in experiment 1 was repeated except that the solvent and conditions were changed. The solvent in experiment 2 was a light hydrocarbon fraction derived from a refinery naphtha stream. It contained 45% n-hexane, 48% branched chain hexanes with the remaining 7% comprising pentanes, heptanes, cyclohexane and benzene. The results are given in Table II.

TABLE II

| Treat # | Temp. (°C.) | Pressure (Atmospheres) | Low Conradson Carbon Product (Solvent Phase) Yield (Wt. %) | Low Conradson Carbon Product (Solvent Phase) Conradson Carbon (Wt. %) | High Conradson Carbon Product (Asphaltic Phase) Yield (Wt. %) | High Conradson Carbon Product (Asphaltic Phase) Conradson Carbon (Wt. %) |
|---|---|---|---|---|---|---|
| 1 | 150 | 8.5 | 64 | 22 | — | — |
| 2 | 150 | 8.5 | 20 | 19 | — | — |
| 3 | 150 | 8.5 | 6 | 22 | 10 | 58 |

What is claimed is:

1. In a fluid coking process comprising the steps of:

(a) contacting a carbonaceous chargestock with hot fluidized solids in a fluidized bed contained in a coking zone at coking conditions to produce coke which deposits on said fluidized solids and a vapor phase product, including heavy and light normally liquid hydrocarbons, and (b) passing said vapor phase product of step (a) to a scrubbing zone and separating at least a portion of said heavy hydrocarbons from said vapor phase product in said scrubbing zone, said separated hydrocarbons having a Conradson carbon content ranging from about 5 to about 50 weight percent, the improvement which comprises:

(c) subsequently contacting at least a portion of said separated hydrocarbons, said portion of separated hydrocarbons having a Conradson carbon content ranging from about 5 to about 50 weight percent, with a solvent in a solvent separation zone at separation conditions to separate said heavy hydrocarbons into a high Conradson carbon hydrocarbonaceous product and a low Conradson carbon hydrocarbonaceous product;

(d) recycling at least a portion of said high Conradson carbon product to said coking zone, and (e) recovering said low Conradson carbon hydrocarbonaceous product of step (c).

2. The process of claim 1 wherein the initial atmospheric pressure boiling point of said heavy hydrocarbons separated from said vapor phase product ranges from about 650° to about 975° F.

3. The process of claim 1 wherein said solvent separation is a solvent extraction process.

4. The process of claim 1 wherein said solvent separation is a solvent deasphalting process.

5. The process of claim 1 wherein said carbonaceous chargestock comprises a hydrocarbonaceous oil having a Conradson carbon content of at least about 5 weight percent.

6. The process of claim 1 wherein said coking conditions include a temperature ranging from about 850° to about 1800° F. and a pressure ranging from about 0 to about 150 psig.

7. The process of claim 1 wherein said coking conditions include a temperature ranging from about 900° to about 1200° F.

8. The process of claim 1 wherein said coking zone is the sole coking zone in said fluid coking process.

* * * * *